US009285117B2

(12) United States Patent
Goldberg

(10) Patent No.: US 9,285,117 B2
(45) Date of Patent: Mar. 15, 2016

(54) AUTOMATED SYSTEM FOR SORTING AND BLENDING DIFFERENT FUEL STOCKS SUCH AS COAL

(75) Inventor: Allen S. Goldberg, Blairsville, PA (US)

(73) Assignee: General Trade Corporation, Braddock, PA (US)

( * ) Notice: Subject to any disclaimer, the term of this patent is extended or adjusted under 35 U.S.C. 154(b) by 965 days.

(21) Appl. No.: 13/481,507

(22) Filed: May 25, 2012

(65) Prior Publication Data

US 2013/0312321 A1 Nov. 28, 2013

(51) Int. Cl.
*B01F 13/00* (2006.01)
*F23K 1/00* (2006.01)

(52) U.S. Cl.
CPC ..... *F23K 1/00* (2013.01); *B01F 13/0013* (2013.01); *F23K 2201/50* (2013.01); *F23K 2201/501* (2013.01); *F23K 2203/103* (2013.01); *F23K 2203/104* (2013.01); *F23K 2203/20* (2013.01)

(58) Field of Classification Search
CPC .... B01F 13/0015; B01F 13/0013; F23K 1/00; F23K 2201/50; F23K 2203/20; F23K 2203/103; F23K 2203/104; F23K 2201/501
USPC ..... 366/16–21, 153.2
See application file for complete search history.

(56) References Cited

U.S. PATENT DOCUMENTS 2,530,501 A * 11/1950 Avril ..... 366/18
2,735,625 A * 2/1956 Preeman ..... 241/18
3,170,677 A * 2/1965 Phister, Jr. et al. ..... 366/16
3,285,580 A * 11/1966 Renaudette ..... 366/153.3
3,661,365 A * 5/1972 Cloud, Jr. ..... 366/18
4,360,044 A * 11/1982 Wisneski ..... 141/9
4,966,463 A * 10/1990 Hihara et al. ..... 366/3
5,251,976 A * 10/1993 Milstead ..... 366/18
2013/0312321 A1 * 11/2013 Goldberg ..... 44/620

FOREIGN PATENT DOCUMENTS

CN 201565282 U 9/2010
JP 04305412 A * 10/1992 ..... B28C 7/14

OTHER PUBLICATIONS

CN201565282U—machine translation.*
International Search Report and Written Opinion of the International Searching Authority for PCT Application PCT/US2013/042336 (dated Aug. 29, 2013) citing CN 201565282 U.

* cited by examiner

*Primary Examiner* — Charles Cooley
(74) *Attorney, Agent, or Firm* — Picadio Sneath Miller & Norton, P.C.; Robert L. Wagner

(57) ABSTRACT

A method and apparatus for automatically sorting and blending coal and other fuel stocks through a computer-controlled process in order to achieve a specified blend of materials. By sorting fuel stocks with different characteristics into different stacking points, an operator can then automatically combine and uniformly blend these sorted fuel stocks to create a variety of blended materials with different properties tailored to the specific needs of the operator or end user. The computer-controlled nature of the process allows for precise blending in an automated and more efficient and reproducible fashion.

5 Claims, 2 Drawing Sheets

AUTOMATED SYSTEM FOR SORTING AND BLENDING DIFFERENT FUEL STOCKS SUCH AS COAL

FIELD OF INVENTION

The present invention generally relates to an apparatus and method for sorting and blending coal and other fuel stocks through an automated, computer-controlled process in order to achieve a specified blend of materials.

BACKGROUND OF THE INVENTION

Power stations, also known as power plants, serve as industrial facilities for generating electric power. In general, many of these power plants rely on coal as the source of energy to generate electricity. These power plants can burn a significant amount of coal per day, e.g. 15,000 tons, at a particular heat value, e.g. 12,200 BTU/pound (British Thermal Unit/pound) for a larger facility. Frequently, coal power plants are located at or near coal mines in order to reduce the costs of obtaining and transporting the coal to the power plant. Thus, these coal power plants are designed to burn coal with the particular characteristics of the nearby coal (e.g., heat value or sulfur content). However, when the coal power plant operations eventually exhaust the economically feasible onsite or nearby coal reserves, the power plants must begin to use coal delivered from other sources. The heat value of the offsite coal may differ drastically from the value of the onsite coal, and, thus, power plants are faced with the problem of using coal that does not match the design parameters of the power plant, which can either reduce the efficiency of the power plant if the offsite coal has a lower heat value or significantly increase the fuel costs by burning higher-than-necessary quality coals.

In addition to the differing heat values, the offsite coal may have differing levels of undesirable non-carbon based elements or other components that adversely affect either the operating efficiency of the boilers that produce the steam for the power plant or the emission limits for the permits held by the power plant. For instance, the presence of too much sulfur or mercury in the coal can cause the power plant emissions to exceed the allowable levels under the applicable permits. The presence of too much ash (and rock and other non-carbon based elements) or moisture can interfere with the efficiency of the boilers and cause a reduction in the overall efficiency of the power plant.

Power plant operators have partially solved these problems by bringing in various grades of offsite coal and manually blending them in order to crudely create a blended coal at roughly the desired heat value or properties for the particular plant. However, this blending is often done by manually mixing one type of offsite coal with another using bulldozers or other moving equipment, which lacks precision in uniformly blending the coal to a specific heat value or property. It also lacks the ability to precisely control the characteristics of the blended coal. Because of the crude nature of the mixing, different portions of the blended coal will have very different characteristics even if the average characteristics meet the desired target values.

Because coal from multiple sources can vary greatly in terms of quality and the mixing is imprecise and not uniform, most power plants will limit their intake and rely on two sources of offsite coal in order to reduce the need for blending the coal as much as possible, or the power plants may choose to procure a higher quality more expensive product that exceeds the optimum burn quality requirement to avoid coal quality issues. As a result, these coal power plants (a) rely on limited coal sources instead of being able to receive coal from any number of providers, (b) blend few types of coal on site manually without much precision or uniformity of the overall blended product, and (c) lack the capacity to blend coal from many sources in an efficient, precise, and uniform manner to meet varying fuel, efficiency, or regulatory requirements.

SUMMARY OF THE INVENTION

Accordingly, the present invention employs a new and novel method for sorting and blending fuel stocks of varying quality or characteristics through an automated, computer-controlled process in order to combine multiple fuel stocks or qualities of fuel stocks to produce an acceptable product for consumption by power plants or other end users. Unlike prior methods, the invention provides for a precise, automated method of blending of fuel stocks to meet the end user's particular requirements or regulatory demands. The invention provides the ability for a facility to receive substantial quantities of fuel stocks with different properties, sort and store these fuel stocks in differing areas, blend different stored fuel stocks in specific proportions, and deliver the blended fuel stock (in a variety of different combinations) to the end user through an automated, computer-controlled process.

In addition, this method provides for the flexibility, if desired, to change the characteristics and properties of the blended fuel stock based on the current needs of the operator or end user. Thus, for example, the invention can automatically provide coal of one heat value at one time of the day and a different heat value at another time of day based on the needs of an end user, such as a coal power plant. This kind of flexibility can be important to coal power plant operators who may not need the highest efficiency coal during off-peak hours, and want to save the highest efficiency (and more expensive) coal for peak-hour usage. This flexibility can also be important to a coal supplier for the pre-blending of coals for various customers with different coal quality requirements.

Furthermore, this invention can be used to reduce the level of certain components or contaminants in the fuel stock to a desired level. For example, an operator can mix coal with high sulfur content and low sulfur content together to create a blended coal with sulfur content within the applicable regulatory limits.

The invention can also be used to eliminate certain types of waste by blending the waste with another fuel stock. For example, an operator can blend coal with wastes, such as tire chips or coal refuse, to form a blended fuel stock that can be used in a particular type of boiler or facility.

This invention could also be used to enhance fuel stocks by blending in additives to increase the performance of the fuel stock. For example, an operator could blend coal with petroleum coke to increase the heat value of the coal.

In one example, an apparatus for sorting and blending fuel stocks, comprising a plurality of intake points to receive the fuel stocks; a plurality of intake feeders coupled to the intake points and to an intake conveyor to transfer the fuel stocks to one of a plurality of stacking tubes; a plurality of transfer conveyors coupled to the intake conveyor to transfer the fuel stocks between the stacking tubes; a plurality of transfer gates coupled to the transfer conveyors to direct the fuel stocks to the stacking tubes; a covered reclaiming chase located below and coupled to the stacking tubes; a reclaiming chase conveyor located in and running within the reclaiming chase; a plurality of reclaiming gates located in a roof of the covered reclaiming chase and positioned to control a flow of the fuel stocks around the stacking tubes through a plurality of reclaiming feeders onto the reclaiming chase conveyor; a plurality of belt scales coupled to the intake conveyor, transfer conveyor, and reclaiming chase conveyor; and a computer system coupled to the intake feeders, transfer gates, reclaiming feeders, intake conveyor, transfer conveyors, and reclaiming chase conveyor to control and monitor the intake feeders, intake conveyor, transfer conveyors, reclaiming feeders, and reclaiming chase conveyor; to control and monitor an opening and closing of the transfer gates and reclaiming gates; and to monitor an amount of the fuel stock passing over the belt scales.

In another example, an apparatus for sorting and blending fuel stocks, comprising an intake point to receive the fuel stocks; an intake feeder coupled to the intake point and to an intake conveyor to transfer the fuel stocks to one of a plurality of stacking points; a transfer conveyor coupled to the intake conveyor to transfer the fuel stocks between the stacking points; a transfer gate coupled to the transfer conveyor to direct the fuel stocks to the stacking points; a reclaiming chase coupled to the stacking points; a reclaiming chase conveyor located in and running within the reclaiming chase; a plurality of reclaiming gates coupled to the reclaiming chase and positioned to control a flow of the fuel stocks around the stacking points through a plurality of reclaiming feeders onto the reclaiming chase conveyor; and a computer system coupled to the transfer gate, reclaiming feeders, intake conveyor, transfer conveyor, and reclaiming chase conveyor to control and monitor the intake conveyor, transfer conveyor, reclaiming feeders, and reclaiming chase conveyor, and to control and monitor an opening and closing of the transfer gate and reclaiming gates.

In a further example, a method for blending fuel stocks, comprising receiving a received fuel stock at an intake point; sorting the received fuel stock into a sorted fuel stock by sending the received fuel stock from the intake point to one of a plurality of stacking points through a coupled intake conveyor and a transfer conveyor; blending the sorted fuel stock into a blended fuel stock by transferring the sorted fuel stock to a reclaiming chase conveyor in a reclaiming chase coupled to the stacking points through a plurality of reclaiming gates and a plurality of reclaiming feeders; and controlling the receiving, sorting, sending, blending, and transferring of the fuel stocks by a computer system.

BRIEF DESCRIPTION OF THE DRAWINGS

The accompanying drawing illustrates an embodiment of the invention and explains the principles of the invention.

DETAILED DESCRIPTION OF THE INVENTION

An exemplary embodiment of the invention is described below. It will be understood by those skilled in the art that variants of this exemplary embodiment can be used to practice the inventions claimed.

Figure 1:
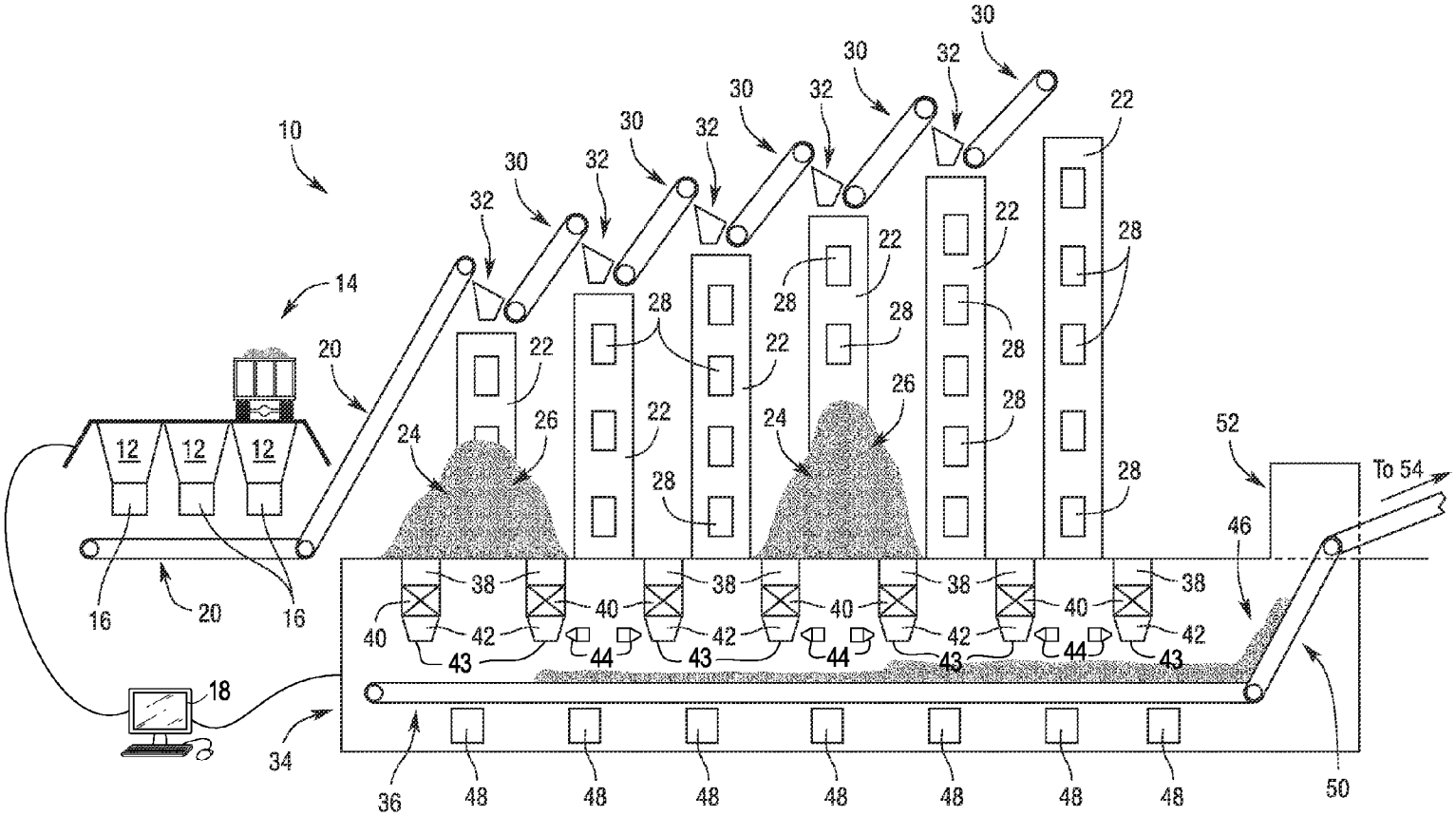
FIG. 1 shows a general schematic of the blending system.

Described below is an exemplary system for automatically sorting and blending coal using a computer-controlled assembly of hoppers, conveyors, gates, stacking tubes, chutes, and belt scales. As shown in FIG. 1, the blending system 10 is comprised of three drive-over intake hoppers 12 that receive coal 14 from dump trucks. Although the intake points in this particular exemplary embodiment are drive-over intake hoppers in which dump trucks can directly dump their loads of received coal 14 into the drive-over hoppers 12, other numbers and types of intake points (such as back-up dumps and dozer traps) and other types of delivery mechanisms (such as barges, train cars, or conveyor belts) could be used instead and fall within the scope of the invention.

Beneath each of the drive-over intake hoppers 12 are intake weigh feeders 16 controlled by a computer system 18. Other intake feeders, such as belt feeders or vibratory feeders, could be used and fall within the scope of the invention. Computer system 18 can independently stop, start, and regulate each weigh feeder 16 to control the amount of coal from each intake hopper 12 that is transferred to the intake conveyor 20. In this way, the blending system operator can premix the received coal 14 before transferring it to the rest of the system. For example, if the operator knows it will be receiving loads of 11,000 and 13,000 BTU/pound coal during the day, it can hold the loads in two of the drive-over intake hoppers 12 and then open the respective weigh feeders 16 to mix the two loads to create a 12,000 BTU/pound blend of coal to be transferred to the rest of the system. While the blending system 10 can process coal of nearly any heat value, it typically receives coal with heat values ranging from 9,000 to 13,000 BTU/pound.

Coal from the intake conveyor 20 is then transferred through a series of connected or linked transfer conveyors 30 to the top of one of six stacking points—in this case, stacking tubes 22. A stacking tube is a structure by which the received coal 14 can be sorted in piles 24 of sorted coal 26. The received coal 14 enters at the top of the stacking tube 22 and falls inside the tube. Openings 28 in the sides of the stacking tube 22 allow the received coal 14 to exit the stacking tube 22 in a controlled manner to form piles 24 of sorted coal 26 surrounding the stacking tube 22. Some additional advantages of stacking tubes 22 are that they reduce the amount of dust created when piling the sorted coal 26 and that they facilitate the stacking of sorted coal 26 without employing a bull dozer or other similar equipment. Given the particular needs and geography of the facility, the particular stacking tubes 22 used in this exemplary embodiment are square in cross section with each side being ten feet long and range in height from 56 to 88 feet. As shown in FIG. 1, these particular stacking tubes 22 contain a series of 4 by 4 feet square openings 28 in each of the sides in order to allow coal placed in the stacking tubes 22 to fall into conical piles 24 around the base of each stacking tube 22. Again, the particular number, dimensions, and geometry of stacking tubes 22 and openings 28 used in this exemplary embodiment are not critical to this invention, and an individual of ordinary skill in the art would recognize that the number, dimensions, and geometry of stacking tubes 22 and openings 28 could be varied and still fall within the scope of this invention. In addition, stacking points other than stacking tubes (such as silos or radial or stationary stacking conveyors) could be used and still fall within the scope of this invention.

Each stacking tube 22 is connected or linked at the top by a series of transfer conveyors 30. In addition, at the top of stacking tubes 22 are transfer gates 32. This exemplary embodiment uses gravity flow diverters or flop gates as transfer gates 32, but one skilled in the art would recognize that other transfer gates could be used and still fall within the scope of this invention. Transfer conveyors 30 and transfer gates 32 are connected and controlled by computer system 18. By controlling which transfer conveyors 30 are on and which transfer gates 32 are open, incoming coal from intake conveyor 20 can be directed to different stacking tubes 22. In this way, the received coal 14 can be sorted into piles 24 corresponding to different qualities or characteristics, such as the heat value (BTU/pound) or the sulfur or mercury content of the coal. In general, the coal that is used more often in the blending process is directed to the taller stacking tubes 22, which have a larger capacity to pile and store the coal. By having multiple stacking tubes 22, the operator can receive, sort, and store a variety of different types of coal that can later be blended in multiple different ways, depending on the operator's needs. In addition, the operator can store the same type of coal in more than one stacking tube, if desired.

Beneath stacking tubes 22 and located in the ground is an 850 foot covered reinforced concrete reclaiming chase 34 that has a 10 by 11 foot internal cross section. Inside this reclaiming chase 34 is a forty-eight inch-wide reclaiming chase conveyor 36 that runs the entire length of the reclaiming chase 34. There are sixteen 6 by 6 foot reclaiming chase openings 38 (not all are shown in FIG. 1) in the roof of the reclaiming chase 34 that have been placed in such a fashion as to allow the sorted coal 26 surrounding each stacking tube 22 to be directed onto the reclaiming chase conveyor 36. Again, the particular dimensions of the reclaiming chase 34, the reclaiming chase conveyor 36, and reclaiming chase openings 38 described in this exemplary embodiment can vary depending on the needs of the operator, the volume of the coal being processed, the location of the blending system 10, and other parameters of the blending system 10 and still fall within the scope of the invention.

As the sorted coal 26 in piles 24 is used, bulldozers or other coal-moving equipment are used to move the sorted coal 26 to make sure that a sufficient amount of sorted coal 26 remains over the reclaiming chase openings 38. Reclaiming gates 40 are placed in the reclaiming chase openings 38 in order to control the flow of the sorted coal 26 onto the reclaiming chase conveyor 36. Each reclaiming gate 40 is independently controlled by computer system 18. In this exemplary embodiment, reclaiming gates 40 are gravity flow slide gates, but other types of gates or diverters could be used and fall within the scope of the invention. Sorted coal 26 from piles 24 can only fall onto reclaiming chase conveyor 36 when computer system 18 opens the appropriate reclaiming gate 40. Reclaiming feeders 42 are located below each reclaiming gate 40 to direct and regulate the flow rate of the sorted coal 26 onto the reclaiming chase conveyor 36. While this exemplary embodiment uses vibratory feeder pans as the reclaiming feeders 42, other types of feeders, such as belt feeders and auger screw feeders, could be used and fall within the scope of this invention. The angle of the discharge end 43 of each reclaiming feeder 42 can be adjusted in order to assist the flow of sorted coal 26 onto the reclaiming chase conveyor 36. In addition, air cannons 44 are connected to each reclaiming feeder 42 in order to dislodge any of the sorted coal that may at times bridge the opening and create blocking of the reclaiming feeder 42.

By opening only certain reclaiming gates 40, sorted coal 26 with different qualities (such as heat value, sulfur content, or mercury content) can be combined together onto the reclaiming chase conveyor 36 to create a blended coal 46 with certain desired characteristics. For example, if the sorted coal 26 around one stacking tube 22 has a heat value of 12,000 BTU/pound and the sorted coal 26 from around another stacking tube 22 has a heat value of 10,000 BTU/pound, computer system 18 can open a reclaiming gate 40 under each of these piles 24 to create an 11,000 BTU/pound blended coal 46. Alternatively, computer system 18 could open one reclaiming gate 40 under the 10,000 BTU/pound pile 24 and three reclaiming gates 40 under the 12,000 BTU/pound pile 24 to create an 11,500 BTU/pound blended coal 46.

By utilizing the various conveyors, feeders, stacking points, and gates, the coal is repeatedly folded and mixed as it passes through the blending system 10, thereby creating a more uniformly blended coal 46 than would be obtained by simply mixing piles of coal with bulldozers or other manual means.

In addition, computer system 18 can control the amount of blended coal 46 exiting the reclaiming chase conveyor 36 by opening multiple reclaiming gates 40 (e.g., doubling the flow by opening twice the number of reclaiming gates 40), by changing the amount the reclaiming gates 40 are opened, by adjusting the angle of the reclaiming feeders 42, and by increasing or decreasing the intensity of the vibration of the reclaiming feeders 42.

Belt scales 48 are placed throughout the blending system 10 in order for the computer system 18 to monitor the amount or weight of coal travelling on the various conveyors in the system. In this way, computer system 18 recognizes how much coal has been received at the drive-over intake hoppers 12, how much coal is being placed into each stacking tube 22, how much coal is being blended onto the reclaiming chase conveyor 36, and how much blended coal 46 is exiting the blending system 10.

The discharge end of the reclaiming chase conveyor 36 is connected or linked to an output conveyor 50 and sent to transfer point 52, the site at which the blended coal 46 can be directed to a coal-fired boiler facility at electrical power plant 54. The exemplary embodiment described above can receive more than 5 million tons of coal annually and deliver as much as 1,200 tons of blended coal 46 (at, for example, 12,200 BTU/pound) to power plant 54. The exemplary embodiment can change both the amount and characteristics of blended coal 46 based on the current needs of power plant 54.

Once the blending system 10 creates blended coal 46, one of ordinary skill in the art would recognize that blended coal 46 can be directed to a variety of destinations, such as storage silos, boiler facilities, trucks, vehicles, barges, ships, train cars, stacking tubes, piles, or other conveyors, depending on the application or the operator's needs.

Figure 2:
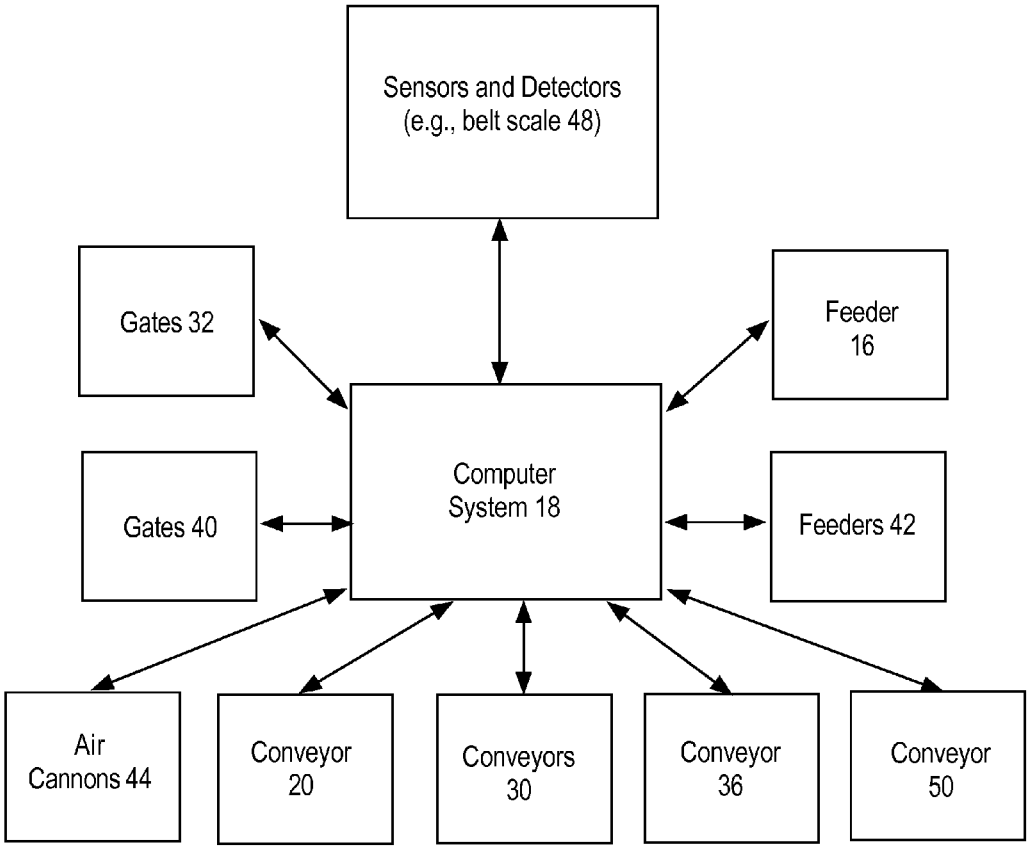
FIG. 2 shows a generalized schematic of the connections between a computer system and various subsystems of a blending system.

Computer system 18 is a series of computers and programmable logic controllers connected or linked by fiber-optic or wire cabling throughout blending system 10. As shown in FIG. 2, Computer system 18 receives inputs from a variety of sensors and detectors, such as interlocks, sensors, belt scales 48, and flow meters. Based on the parameters set by the operator, computer system 18 can control the various subsystems in blending system 10, including conveyors 20, 30, 36, and 50, feeders 16 and 42, gates 32 and 40, and air cannons 44. Computer system 18 can open and close the various gates, turn on and off the various conveyors, and adjust the vibration of the feeders. Computer system 18 also maintains information about what type and amount of coal is available in each location of blending system 10, including what type of coal has been received at each drive-over intake hopper 12, what type of coal is being transported by intake conveyor 20, what type of coal is being transported by transfer conveyors 30, what type of coal is in each pile 24 around each stacking tube 22, and what type of coal is being blended onto reclaiming chase conveyor 36. The precise connections and programming of computer system 18 depends on the equipment being used and how it has been located and configured. One of ordinary skill in the art would recognize that the computer system 18 could be configured in a variety of different manners, depending on the equipment used and the control desired by the user.

In another embodiment, an end user, such as power plant 54, could send a signal to the blending system 10 directing that a certain quality of coal (for example, a heat value of 12,200 BTU/pound) be delivered to the end user. Computer system 18 would then make the appropriate calculations based on the sorted coal 26 that is present and automatically adjust the blending system 10 to deliver the requested blended coal 46 directly to the end user. This could also be accomplished by installing a coal analyzer that instantaneously samples and analyzes the blended product and then relays that information to computer system 18 that then adjusts the blend ratios accordingly.

While the exemplary embodiment of blending system 10 blends various types and grades of coal as its fuel stock, the invention is not limited to just blending coal. Rather, one of ordinary skill in the art would recognize that other fuel stocks may be blended, including but not limited to biomass, coke, sawdust, tire scrap, filter cake (pod fines), and coal refuse. By blending various materials together in blending system 10, an operator may create a blended material that has specific desired properties, such as a particular heat value (BTU/pound) or sulfur content at or below a specified level. Blending system 10 may also be used to eliminate less desirable materials by combining them in appropriate quantities with other materials. For example, an operator could still utilize low heat value coal that would otherwise not be suitable for the operator's desired application by combining it with higher heat valued coal to form a blend of coal with an acceptable or useful heat value. An operator could also still utilize coal with an inappropriately high contaminant by blending it with a purer coal such that the average contaminant content fell below acceptable levels.

The foregoing description has been presented for purposes of illustration and description, and is not intended to be exhaustive or to limit the invention to the precise form disclosed. The descriptions were selected to explain the principles of the invention and their practical application to enable others skilled in the art to utilize the invention in various embodiments and various modifications as are suited to the particular use contemplated. Although particular constructions of the present invention have been shown and described, other alternative constructions will be apparent to those skilled in the art and are within the intended scope of the present invention.

I claim:

1. An apparatus for sorting and blending different fuel stocks, comprising:

a plurality of intake hoppers to receive the different fuel stocks;

a plurality of intake feeders coupled to the intake hoppers, wherein the intake feeders are independently controlled to hold or release the different fuel stocks;

an intake conveyor coupled to the intake feeders to transfer the different fuel stocks to one of a plurality of stacking tubes;

a plurality of transfer conveyors coupled to the intake conveyor to transfer the different fuel stocks between the stacking tubes;

a plurality of transfer gates coupled to the transfer conveyors to direct the different fuel stocks to the stacking tubes;

a covered reclaiming chase located below and coupled to the stacking tubes;

a reclaiming chase conveyor located in and running within the covered reclaiming chase;

a plurality of reclaiming gates located in a roof of the covered reclaiming chase and positioned to control a flow of the different fuel stocks around the stacking tubes through a plurality of reclaiming feeders onto the reclaiming chase conveyor;

a plurality of belt scales coupled to the intake conveyor, transfer conveyors, and reclaiming chase conveyor; and a computer system coupled to the intake feeders, transfer gates, reclaiming feeders, intake conveyor, transfer conveyors, and reclaiming chase conveyor to control and monitor the intake feeders, intake conveyor, transfer conveyors, reclaiming feeders, and reclaiming chase conveyor;

to control and monitor an opening and closing of the transfer gates and reclaiming gates; and to monitor an amount of the different fuel stocks passing over the belt scales.

2. An apparatus for sorting and blending different fuel stocks, comprising:

a plurality of intake points to receive the different fuel stocks;

a plurality of intake feeders coupled to the intake points, wherein the intake feeders are independently controlled to hold or release the different fuel stocks;

an intake conveyor coupled to the intake feeders to transfer the different fuel stocks to one of a plurality of stacking points;

a transfer conveyor coupled to the intake conveyor to transfer the different fuel stocks between the stacking points;

a transfer gate coupled to the transfer conveyor to direct the different fuel stocks to the stacking points;

a covered reclaiming chase coupled to the stacking points;

a reclaiming chase conveyor located in and running within the covered reclaiming chase;

a plurality of reclaiming gates coupled to the covered reclaiming chase and positioned to control a flow of the different fuel stocks around the stacking points tubes through a plurality of reclaiming feeders onto the reclaiming chase conveyor; and a computer system coupled to the intake feeders, transfer gate, reclaiming feeders, intake conveyor, transfer conveyor, and reclaiming chase conveyor to control and monitor the intake feeders, intake conveyor, transfer conveyor, reclaiming feeders, and reclaiming chase conveyor, and to control and monitor an opening and closing of the transfer gate and reclaiming gates.

3. The apparatus of claim 2 in which an angle of a discharge end of the reclaiming feeders is adjustable.

4. The apparatus of claim 2, further comprising:

a belt scale coupled to at least one of the intake conveyor, intake feeders, transfer conveyor, and reclaiming chase conveyor, and the computer system further coupled to the belt scale to monitor an amount of the different fuel stocks passing over the belt scale.

5. The apparatus of claim 2 in which a discharge end of the reclaiming chase conveyor is coupled to at least one of a power plant, a silo, a stock pile, a boat, a truck, a vehicle, a train car, a boiler, or an additional conveyor.

* * * * *